US008020859B2

(12) United States Patent
deJong et al.

(10) Patent No.: US 8,020,859 B2
(45) Date of Patent: Sep. 20, 2011

(54) EDGE SENSOR GAIN CALIBRATION FOR PRINTMAKING DEVICES

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 225 days.

(21) Appl. No.: 12/547,762

(22) Filed: Aug. 26, 2009

(65) Prior Publication Data

US 2011/0049793 A1 Mar. 3, 2011

(51) Int. Cl.
*B65H 7/02* (2006.01)

(52) U.S. Cl. ..... 271/228; 271/227; 271/252; 399/395

(58) Field of Classification Search ..... 271/227, 271/228, 252; 399/395
See application file for complete search history.

(56) References Cited

U.S. PATENT DOCUMENTS 5,094,442 A 3/1992 Kamprath et al.
5,273,274 A * 12/1993 Thomson et al. ..... 271/228
5,715,514 A * 2/1998 Williams et al. ..... 399/395
6,059,285 A * 5/2000 Suga et al. ..... 271/228
6,168,153 B1 1/2001 Richards et al.
6,276,586 B1 * 8/2001 Yeo et al. ..... 226/17
6,533,268 B2 3/2003 Williams et al.
6,575,458 B2 6/2003 Williams et al.
6,637,634 B1 * 10/2003 Yeo et al. ..... 226/42
7,422,211 B2 9/2008 Dejong et al.
7,631,867 B2 * 12/2009 Dejong et al. ..... 271/227
2009/0166960 A1 * 7/2009 Ishikawa et al. ..... 271/227

* cited by examiner

*Primary Examiner* — Stefanos Karmis
*Assistant Examiner* — Luis A Gonzalez
(74) *Attorney, Agent, or Firm* — Hoffmann & Baron, LLP

(57) ABSTRACT

According to aspects illustrated herein, there is provided a method, a system, and a printmaking device for calibrating sensors. The method begins by transporting a media sheet along a media path, the sheet having a lead edge, a trail edge and a measurement edge. Next, the method halts the forward motion of the sheet after the lead edge of the sheet passes a fixed reference. After that, the method moves the sheet laterally relative to the media path across the at least one edge sensor using a sheet actuator. Then, the method records an actual position of the sheet actuator and an output of at least one edge sensor. Finally, the method calculates a calibration factor based on the actual position of the sheet actuator and the output of the at least one edge sensor.

28 Claims, 7 Drawing Sheets

EDGE SENSOR GAIN CALIBRATION FOR PRINTMAKING DEVICES

This disclosure generally relates to a method and device for calibrating sensor output in response to a change in the sheet edge position. In particular, this disclosure provides for a method and device of calibrating the sensors often enough to provide sufficient precision in spite of any potential sensor drift and would permit the use of significantly lower cost sensors.

BACKGROUND

Sheet registration systems are well known in the art and used to control, correct, and change the orientation and/or position of a sheet. Sheet registration systems use nips to drive paper along a feed path. The nips consist of a driven wheel and an idler wheel. The nips are mounted with bearings on a shaft so that the nips can rotate and translate. An angular velocity is imported on each of the driven wheels with a motor, which may be connected directly to the driven wheels or may be connected through a transmission (e.g., a timing belt). The motor may be a stepper motor or a DC servo motor with encoder feedback from an encoder mounted on either the motor shaft, driven wheel shaft, or idler shaft. Only one encoder is necessary for each set of nips to control the angular velocity of the driven wheel. The other two encoders may or may not provide additional functionality, but could be removed to save costs.

The nips are mounted such that they can move in the y-direction. In the teachings of U.S. Pat. No. 5,094,442, the inboard and outboard motors, nips, etc. are all mounted inside a carriage that can move in the y-direction. U.S. Pat. Nos. 6,533,268 and 6,585,458 disclose a different mechanism to allow a y-direction motor with an appropriate actuator. According to this method the sheet can move in three degrees of freedom, i.e. x-direction (or process), y-direction (or lateral), and angular (or skew). The average of the velocities of each of the nips impart the process velocity, the differences in the nip velocities impart the angular velocity, and the y-direction actuator imparts a lateral motion.

U.S. Pat. No. 7,422,211 provides an example of a method for closed loop feedback for skew and lateral registration. The method uses edge sensors to measure the lateral and skew positions of the sheet and feeds the information back to controllers which manipulate the lateral and skew actuator. The current devices, which may use the method of U.S. Pat. No. '211 require the use of expensive sensors to obtain benchmark media registration accuracy. Although lower cost sensors may be used, the lower cost sensors do not exhibit consistent input/output properties.

Therefore, it is desirable to provide a method for calibrating edge sensors often and with a sufficient level of precision. Additionally, use of the method for calibrating edge sensors would allow for the use of low cost sensors capable of providing lateral registration of the sheet with high registration accuracy. Furthermore, there is a desire to use a calibration method with low cost sensors that can deliver several orders of magnitude better resolution than current registration methods deliver.

SUMMARY

According to aspects illustrated herein, there is provided a method for calibrating sensors in a printmaking device. The method begins by transporting a media sheet along a media path, the sheet having a spaced apart lead edge and trail edge with a measurement edge therebetween. Next, the method halts the forward motion of the sheet after the lead edge of the sheet passes a fixed reference. After that, the method, moves the sheet laterally relative to the media path across the at least one edge sensor using a sheet actuator. The sheet actuator being configured to measure a lateral position of the measurement edge of the sheet. Then, the method records an actual position of the sheet actuator with reference to the media path and an output of at least one edge sensor. Finally, the method calculates a calibration factor based on the actual position of the actuator and the output of the at least one edge sensor.

According to further aspects illustrated herein, there is provided a system for use with a printmaking device to calibrate sensors. The system includes a media sheet, at least one edge sensor and a registration device. The media path adapted to transport the sheet having a spaced apart lead edge and trail edge with a measurement edge therebetween. The at least one edge sensor is located along the media path, the at least one edge sensor being configured to measure a position of the measurement edge of the sheet. The registration device having a pair of nips and being configured to move laterally relative to the media path. The registration device calibrates at least one edge sensor using a sheet actuator, with the sheet actuator configured to measure lateral positions of the measurement edge of the sheet. The registration device calibrates the at least one edge sensor by: halting forward motion of the sheet after the lead edge of the sheet passes a fixed reference; moving the sheet across the at least one edge sensor using the sheet actuator; recording an actual position of the sheet actuator with reference to the media path; recording an output of the at least one edge sensor; and calculating a calibration factor based on the actual position of the actuator and the output of the at least one edge sensor.

According to further aspects illustrated herein, there is provided a printmaking device. The printmaking device includes a calibration system having a media path, at least one edge sensor, a registration device, and a controller. The media path adapted to transport a media sheet having a spaced apart lead edge and a trail edge with a measurement edge therebetween. The media path including at least one pair of nips configured to transport the sheet to the registration device and allow lateral movement of the sheet in the registration device. The at least one common sensor configured to register the timing of the sheet as the sheet is transported along the media path. The at least one edge sensor is located along the media path, and is configured to measure a position of the measurement edge of the sheet. The registration device is located along the media path. The registration device including a pair of nips and is configured to move laterally relative to the media path. The registration device calibrates at least one edge sensor using a sheet actuator. The sheet actuator is configured to measure lateral positions of the measurement edge of the sheet, and the at least one edge sensor capable of measuring lateral positions of the sheet. The controller is configured to collect and store measured lateral positions of the sheet. The printmaking device calibrates the at least one edge sensor using the following steps: halting forward motion of the sheet after the lead edge of the sheet passes a fixed reference using the registration device; moving the sheet across the at least one edge sensor using the sheet actuator; recording an actual position of the sheet actuator with reference to the media path; recording an output of the at least one edge sensor; and calculating a calibration factor based on the actual position of the actuator and the output of the at least one edge sensor.

Additional features and advantages will be readily apparent from the following detailed description, the accompanying drawings, and the claims. It is to be understood, however, that the drawings are designed as an illustration only and not as a definition of the limits of the disclosure.

BRIEF DESCRIPTION OF THE DRAWINGS

Like reference symbols in the various drawings indicate like elements.

DETAILED DESCRIPTION

Figure 1:
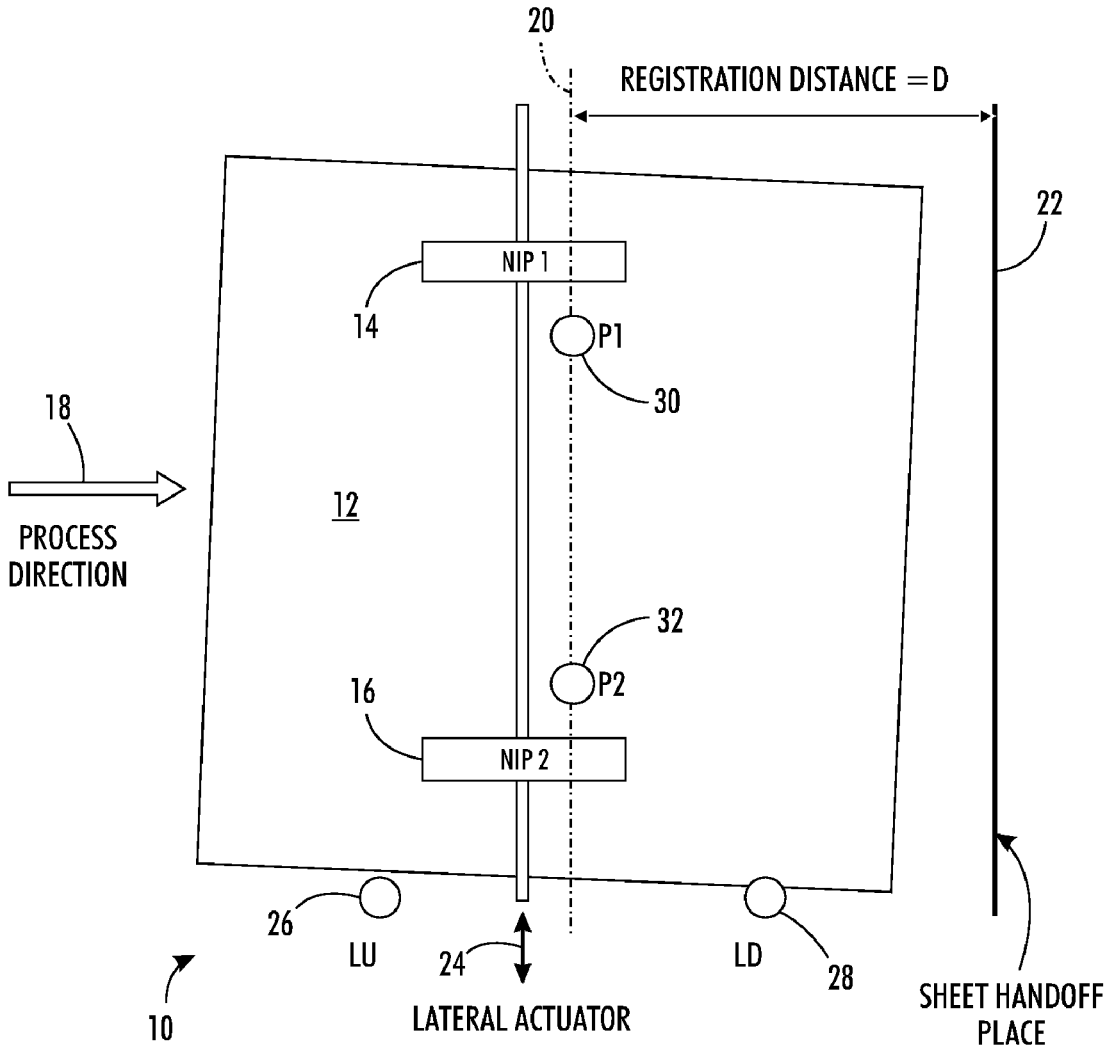
FIG. 1 PRIOR ART
FIG. 1 illustrates a prior art schematic diagram of a sheet registration system for use with a skew and lateral registration method.

A method, system, and printmaking device are disclosed herein for calibrating edge sensors using a sheet actuator.

As used herein, the phrase "printmaking device" encompasses any apparatus, such as a digital copier, a bookmaking machine, a facsimile machine, and a multi-function machine, which use marking technologies to perform a printing outputting function for any purpose. Examples of devices using marking technologies include xerographic, inkjet, and offset marking. The printmaking devices may feed blank or preprinted sheets into devices that use marking technologies, but the printmaking device may not do any printing.

As used herein, the terms "sheet" or "media sheet" encompass, for example, one or more of a usually flimsy physical sheet of paper, heavy media paper, coated papers, transparencies, parchment, film, fabric, plastic, or other suitable physical print media substrate on which information can be reproduced.

As used herein, the phrase "media path" or "feed path" encompasses any apparatus for separating and/or conveying one or more printed sheets into a substrate conveyance path inside a printmaking device.

As used herein, the phrase "lead edge" refers to the edge of a sheet that first advances along the substrate conveyance path.

As used herein, the phrase "trail edge" refers to the edge of a sheet opposite the lead edge. The trail edge is substantially parallel to the lead edge.

As used herein, the phrase "measurement edge" refers to the edge being measured by one or more edge sensors and is an edge adjacent and substantially perpendicular to the lead edge and the trail edge.

As used herein, the phrase "halting" refers to a momentary deceleration of the sheet, which may include the sheet being paused for a brief time or the sheet being fully stopped.

As used herein, the phrase "optical sensors" refer to a sensor that detects the intensity or brightness of light.

As used herein, the phrase "fixed reference" refers the alignment and configuration of the sensor, which points at a non-changing location to where the sensor collects information. The reference is a fixed reference because the sensor will only detect activity at the configured location. For example, a fixed reference may be a specific location on the feed path and the sensor may detect when paper is at that specific location.

As used herein, the terms "calibrating" and "calibration" refer to the validation of sensors. Specifically, a lateral position measurement of a sensor is validated by comparing the sensor reading to a known lateral position. In this case, the known lateral position is the position of a lateral carriage corresponding to a location of the sheet. If inaccuracy is found, the sensor may be adjusted.

As used herein, the phrase "calibration factor" refers to the slope of the sensor, which is referenced in terms of volts per mm (position).

As used herein, the phrase "sheet actuator" refers to a device that facilitates lateral movement of a sheet.

As used herein, the phrase "position transducer" refers to a device operatively connected to the sheet actuator and capable of determining a lateral position of the sheet actuator with respect to a fixed reference.

As used herein, the phrase "step motor" refers to a device operatively connected to the sheet actuator and capable moving the sheet actuator laterally in predefined increments with respect to a fixed reference. The step motor enables the determination of the lateral position of the sheet actuator with respect to a fixed reference.

FIG. 1 provides a known sheet registration system 10 for registering a sheet 12 in a printmaking device. The system 10 includes two driven rollers 14, 16 which form nips with idler rolls (not shown). The driven rollers 14, 16 and idler rolls are rotatably mounted and are positioned to drive the sheet 12 in the direction of arrow 18 through the registration system 10. Registration of the sheet 12 is accomplished within a registration distance D between a dashed line 20 and a sheet handoff place 22. A conventional process direction motor 24 imposes an average velocity on the driven rollers 14, 16 and propels the sheet 12 in the process direction 18.

En route to sheet handoff place 22, the sheet 12 encounters a first sensor 26 and a second sensor 28 that are used to measure the lateral and skew position of the sheet 12. These measurements are fed back to a controller (not shown) that manipulates conventional lateral actuator (not shown) and skew actuator (not shown). The first sensor 26 is used for lateral feedback control and the difference in the reported position of the first sensor 26 and the second sensor 28 is used for skew feedback control. The first sensor 26 and the second sensor 28 can be point sensors and may be located in a predetermined position based upon the sheet 12 size or desired media position. A third sensor 30 and a fourth sensor 32 are also included in the system 10 and are configured to detect the arrival of the sheet 12 in the nips of the driven rollers 14, 16 and start the lateral and skew registration.

Figure 2:
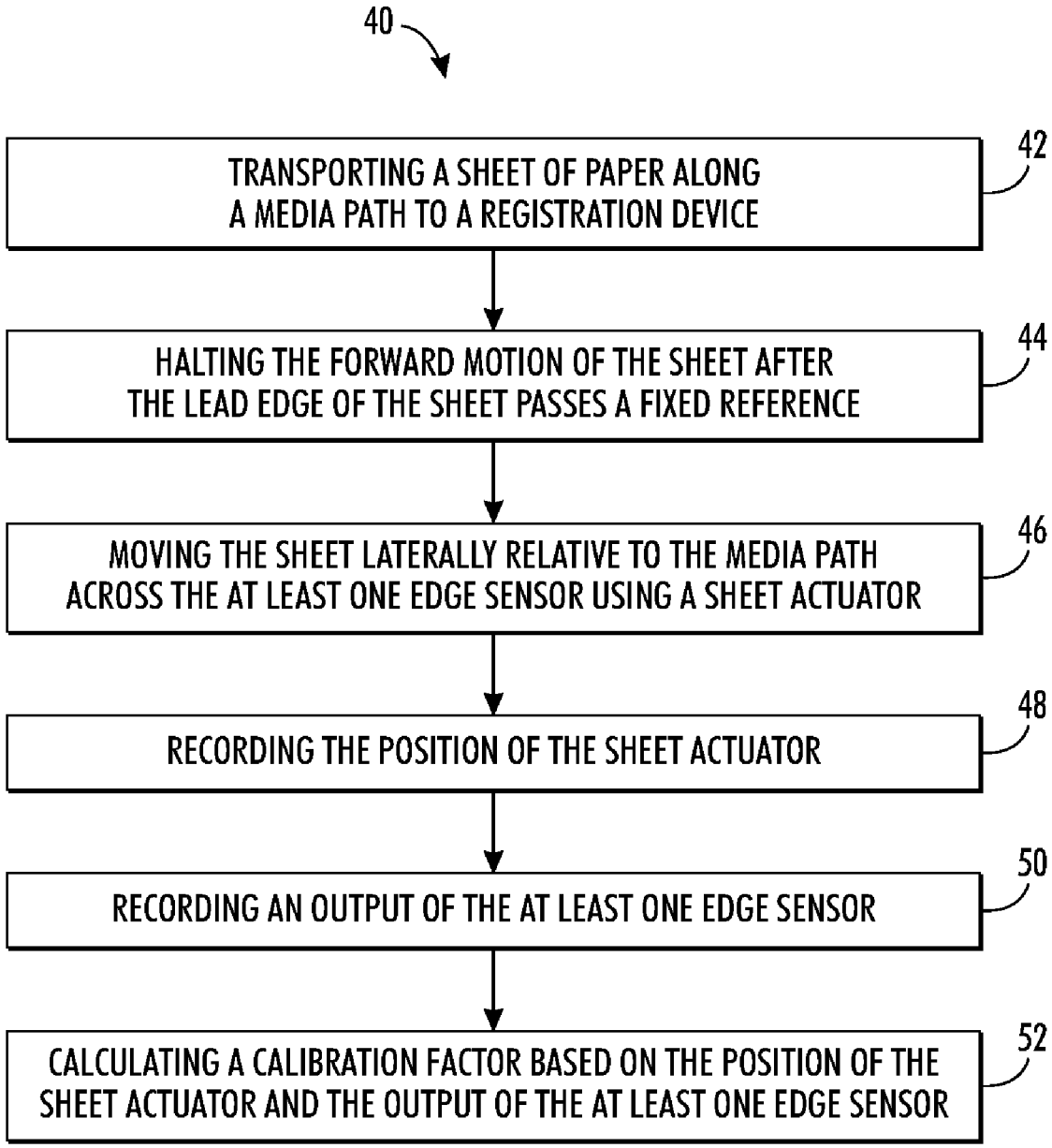
FIG. 2 illustrates a method for calibrating sensors in a sheet registration system for use with a printmaking device.

With reference to FIG. 2, a method 40 for calibrating sensors in a printmaking device is provided. The method calibrates edge sensors using the following steps. First, in step 42 a sheet of paper is transported along a media path to a registration device. The sheet having a spaced apart lead edge and trail edge with a measurement edge therebetween. The registration device including at least one edge sensor.

Next, step 44 halts the forward motion of the sheet after the lead edge of the sheet passes a fixed reference. One or more common sensors may be used to detect a process position of the lead edge of the sheet along the media path. After that, the sheet is moved laterally relative to the media path across the at least one edge sensor using a sheet actuator, in step 46. The sheet actuator is configured to measure a lateral position of the sheet. The sheet actuator may measure the lateral positions of a lateral carriage corresponding to a location of the sheet to determine the lateral position of the sheet. Then, the position of the sheet actuator is recorded with reference to the media path in step 48 and an output of the at least one edge sensor is recorded in step 50. Finally, step 52 calculates a calibration factor based on the position of the sheet actuator and the output of the at least one edge sensor.

The steps of method 40 may be repeated multiple times to obtain statistically significant results; for example, 20-30 times. After repeating the steps of the method 40, the outputs of each of the edge sensors may be averaged and the positions recorded by the sheet actuator may be averaged to ensure statistical significance. The above calibration steps are performed while the printmaking device is not printing. Moreover, the sheet used in the calibration may be transported along the media path and past the registration device after such calibration is completed.

Figure 3:
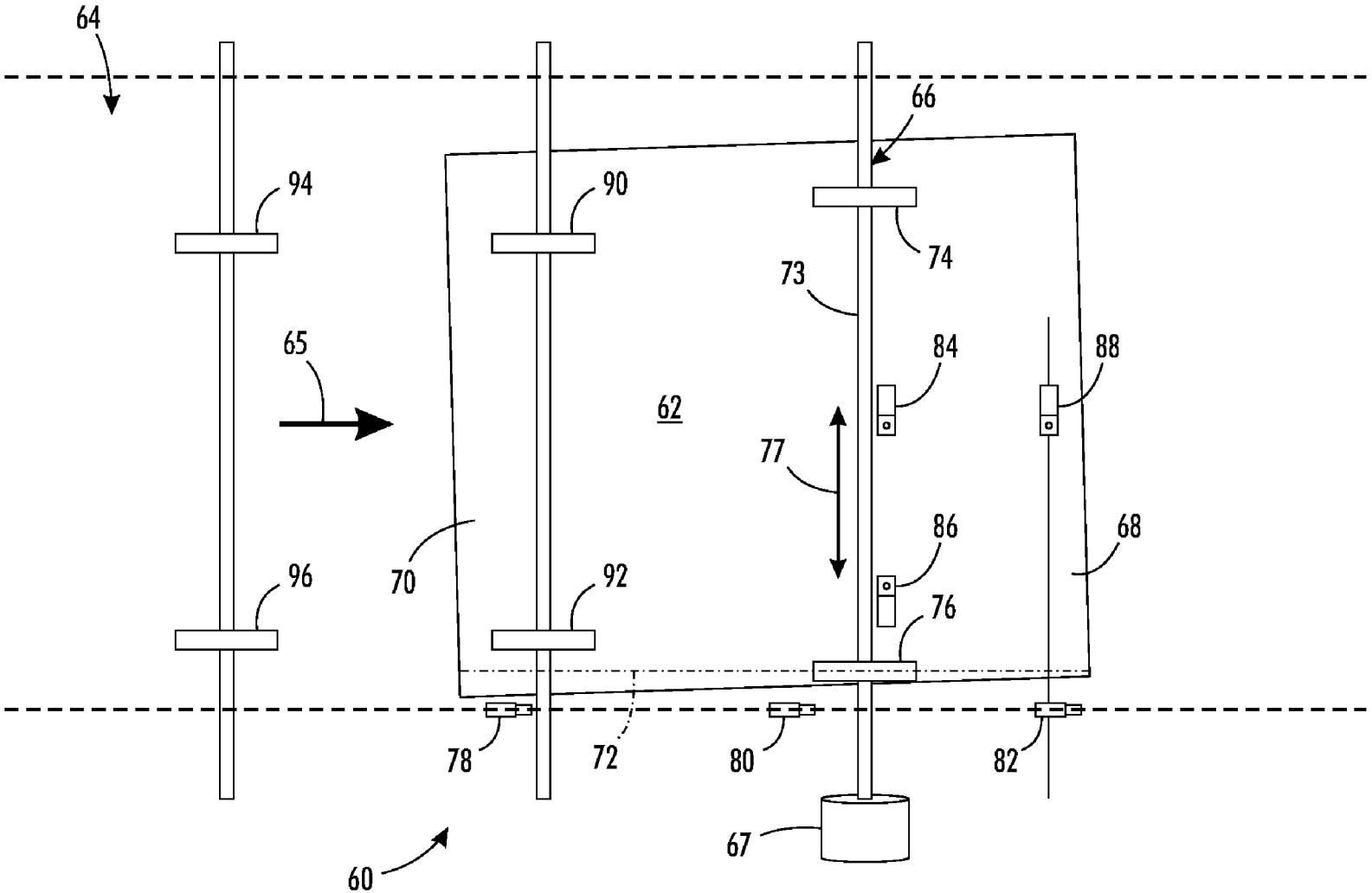
FIG. 3 illustrates a sheet registration system for use with the method of FIG. 2.

FIG. 3 provides an exemplary sheet registration system 60 for use with the method 40 of FIG. 2. The system 60 includes a media sheet 62, a media path 64, at least one edge sensor, and a registration device 66. The media path 64 is adapted to transport the sheet 62, in a process direction 65 with the sheet 62 having a lead edge 68 parallel to a trail edge 70 and a measurement edge 72 adjacent to and approximately perpendicular to the lead edge 68 and the trail edge 70.

The registration device 66 having a lateral carriage 73 with a pair of drive rollers 74, 76 forming nips with idler rollers (not shown). The nips capable of moving and/or halting the sheet 62 as the sheet 62 is transported on the media path 64. The registration device 66 being configured to move laterally 77 relative to the media path 64.

The at least one edge sensor is illustrated as three edge sensors 78, 80, 82 in the system 60. The three edge sensors 78, 80, 82 may be configured to have high sheet to sheet repeatability. Depending on the system 60 configuration, the system 60 may use only one edge sensor, two edge sensors, or more than three edge sensors with each edge sensor functioning in a manner described herein.

The registration device 66 calibrates at least one edge sensor using a sheet actuator 67. The sheet actuator 67 is configured to measure lateral positions of the lateral carriage 73 corresponding to the location of the sheet 62. The position of the sheet actuator 67 may be measured by a device operatively connected to the sheet actuator 67 and capable of determining lateral position with reference to the media path 64. Examples of such devices include a position transducer and a step motor.

In particular, the registration device 66 provided herein calibrates the at least one edge sensor by: halting the forward motion of the sheet 62 after the lead edge 68 of the sheet 62 passes a fixed reference; moving the sheet 62 across the at least one edge sensor using the sheet actuator 67; recording a position of the sheet actuator 67 with reference to the media path 64 and an output of the at least one edge sensor; and calculating a calibration factor using the position of the sheet actuator 67 and the output of the at least one edge sensor. The calibration of the at least one edge sensor may be performed prior to printing on the sheet 62.

The system of FIG. 3 may further include at least one common sensor configured to detect a process position of the sheet 62 along the media path 64. FIG. 3 provides a first common sensor 84, a second common sensor 86, and a third common sensor 88. The system 60 may also include at least one pair of media path rollers configured to control the sheet 62 along the media path 64. FIG. 3 shows a first pair of media rollers 90, 92 and a second pair of media rollers 94, 96.

The system may be located on the opposite end of the media path 64 and the measurement edge 72 may be the edge opposite the edge shown in FIG. 3. The system 60 may be configured to repeat the calibration of the edge sensors multiple times to obtain statistically significant results. When the calibration is repeated, the outputs of the edge sensors are averaged and the positions of the sheet actuator 67 are averaged. After the calibration is completed, the sheet 62 may be transported along the media path 64 past the registration device 66. Note, the calibration of the edge sensors occurs while the printmaking device is not printing on the sheet 62.

Figure 4:
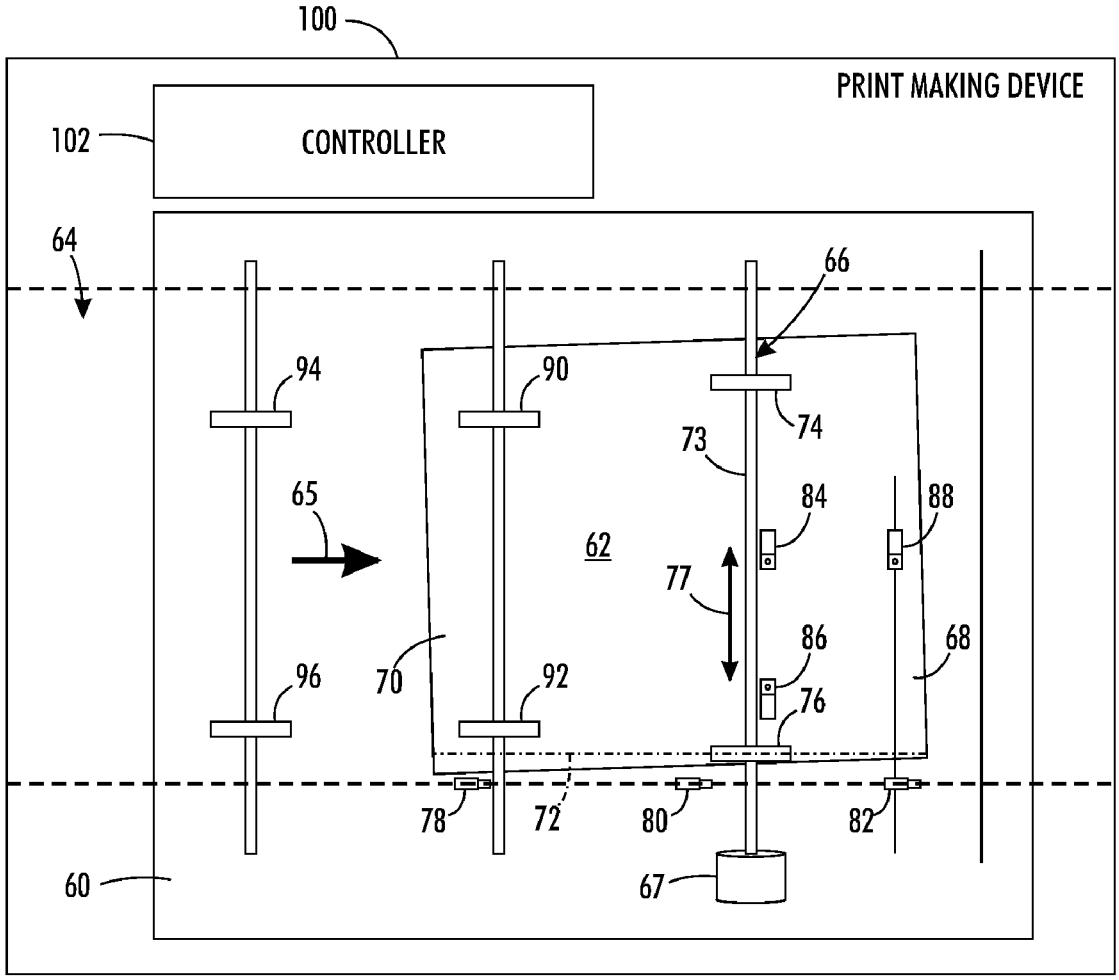
FIG. 4 illustrates a printmaking device for use within the method of FIG. 2, and the system of FIG. 3.

Referring to FIG. 4, an example for a printmaking device 100 for use with the method 40 of FIG. 2 and the system 60 of FIG. 3 is provided. The printmaking device 100 having a media path 64; a sheet registration system 60, at least one edge sensor, and a controller 102. The media path 64 is adapted to transport a media sheet 62, the sheet 62 having a lead edge 68, a trail edge 70, and a measurement edge 72. The controller 102 may be configured to collect and store the measured lateral positions of the sheet 62 from the sheet registration system 60 and the at least one edge sensor.

The system 60 includes the registration device 66 along the media path 64. The registration device has a lateral carriage 73 with at least one pair of drive rollers 74, 76 configured to transport the sheet 62 to the registration device 66 and allow lateral movement 77 of the sheet 62 in the registration device 66 relative to the media path 64.

The registration device 66 calibrates the at least one edge sensor using a sheet actuator 67. The sheet actuator 67 being configured to measure lateral positions of the lateral carriage 73 corresponding to the location of the sheet 62. The at least one edge sensor is capable of measuring lateral positions of the sheet 62. For example, the sheet actuator 67 may use a position transducer to measure the lateral position of the registration device 66. A further example includes the sheet actuator 67 using a step motor to move the registration device 66 laterally in pre-defined increments.

The sheet registration system 60 shown uses three edge sensors 78, 80, 82. The edge sensors 78, 80, 82 are located along the media path 64 and configured to measure a position of the sheet 62 with high sheet to sheet repeatability. Although three edge sensors 78, 80, 82 are shown in this example, the printmaking device 100 only needs at least on edge sensor to work as discussed herein.

The printmaking device 100 calibrates the at least one edge sensor, while the printmaking device 100 is not printing, using the following steps: halting forward motion of the sheet 62 after the lead edge 68 of the sheet 62 passes a fixed reference using the registration device 66; moving the sheet 62 across the at least one edge sensor using the sheet actuator 67; recording an actual position of the sheet actuator 67; recording an output of the at least one edge sensor with reference to the media path 64; and calculating a calibration factor in the controller 102 based on the actual position of the actuator and the output of the at least one edge sensor.

The system 60 may be configured to repeat the calibration of the three edge sensors 78, 80, 82 multiple times to obtain statistically significant results. When the calibration is repeated, the outputs 112, 114, 116 of the edge sensors 78, 80, 82 are averaged and the positions of the sheet actuator 67 are averaged. After the calibration is completed, the sheet 62 may be transported along the media path 64 past the registration device 66. Note, the calibration of the edge sensors 78, 80, 82 occur while the printmaking device 100 is not printing on the sheet 62.

The system 60 may further include at least one common sensor configured to register the timing of the sheet 62 as the sheet 62 is transported along the media path 64.

Figure 5:
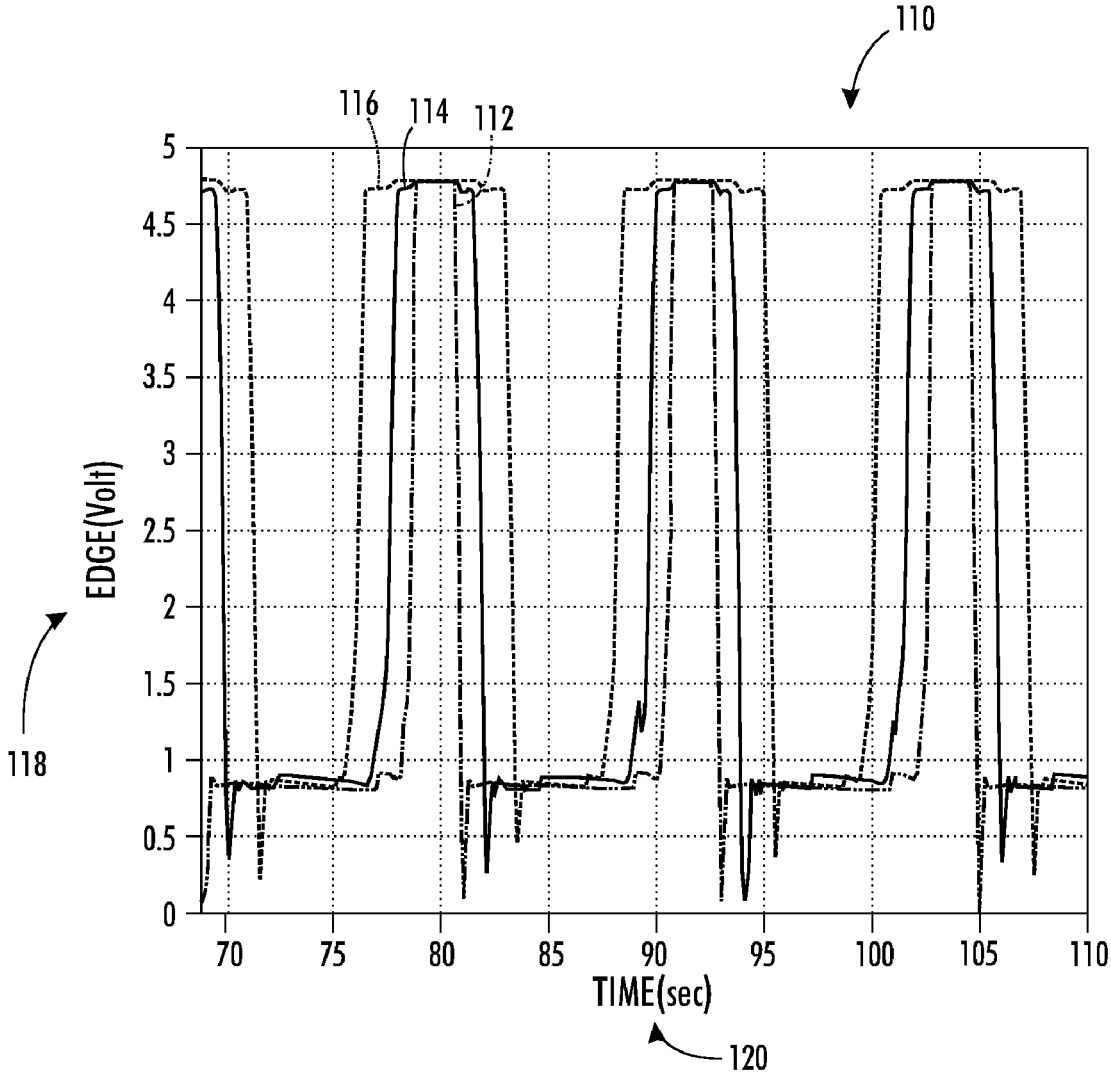
FIG. 5 illustrates a calibration curve based on the recording of three edge sensors as a sheet is moved laterally multiple times using the method of FIG. 2.
Figure 6:
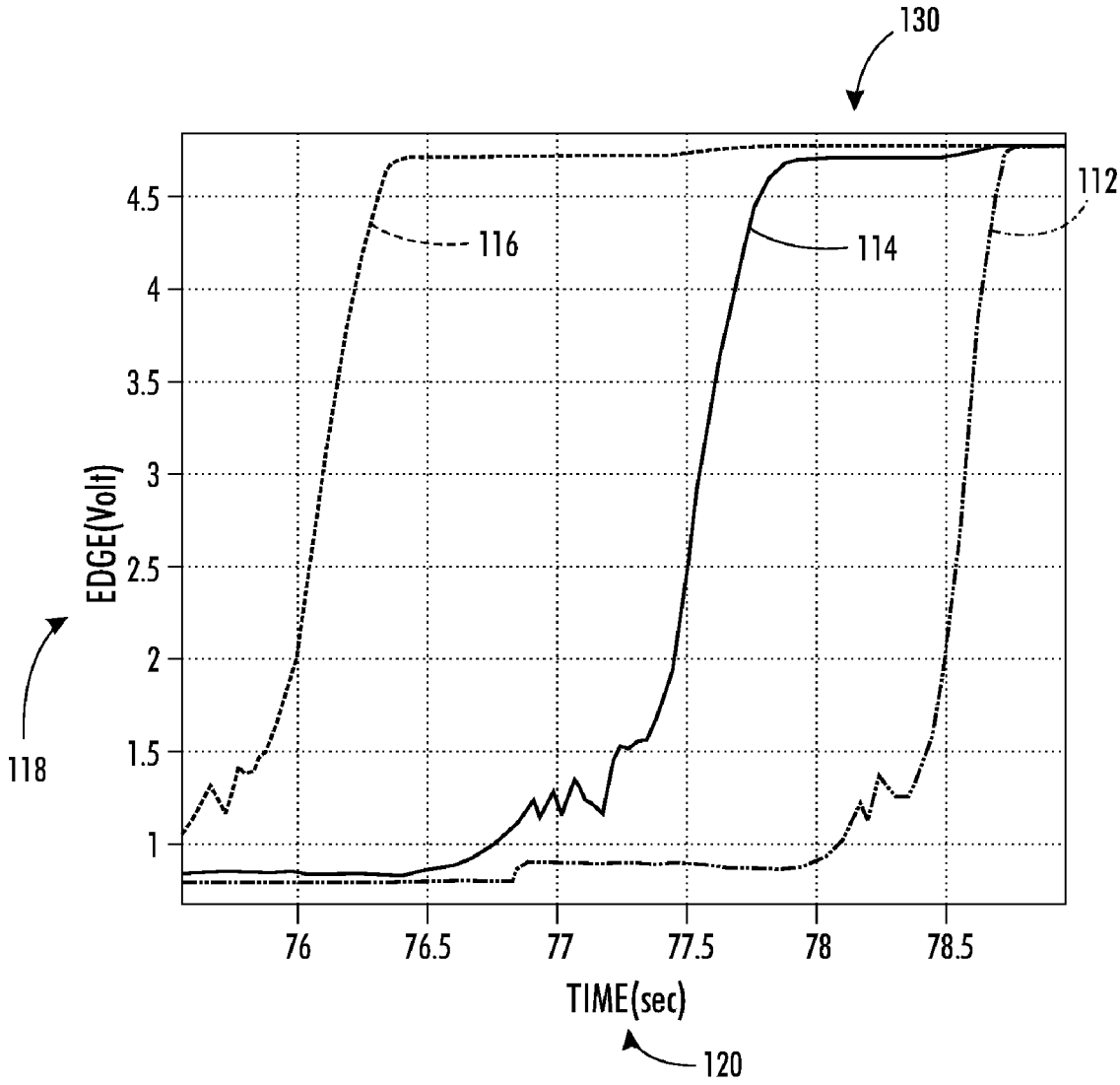
FIG. 6 illustrates a partial view of the calibration curve of FIG. 4.

With reference to FIGS. 5-6, an example of a graph 110 plotting the lateral movement 77 of the sheet 62. The graph 110 of FIG. 5 depicts recordings of the output 112, 114, 116, of the three edge sensors 78, 80, 82, and plots the sheet 62 movement using the three edge sensor outputs 112, 114, 116, in terms of volts 118, as a function of time 120. FIG. 5 is an example of three outputs 112, 114, 116 of the sheet 62 crossing each of the edge sensors 78, 80, 82 three times. For statistical averaging the method would be performed approximately 20 to 30 times and each iteration may be plotted as shown in FIG. 5.

Specifically, in FIGS. 5-6 the x-axis is the time 120, which may be converted to a distance position 132 by multiplication with the velocity, and the y-axis is the output 112, 114, 116 of each of the sensors 78, 80, 82, which is measured in voltage 118 in this case. The slope is shown in FIG. 5 as the sheet 62 crosses the edge sensor going both ways, i.e. laterally towards the edge sensors 78, 80, 82 and away from the edge sensors 78, 80, 82. As the sheet 62 moves laterally 77 towards the edge sensors 78, 80, 82, the volts 118 are plotted in FIGS. 5 and 6 as increasing. Conversely, as the sheet 62 moves laterally 77 away from the edge sensors 78, 80, 82, the volts 118 are plotted in FIG. 5 as decreasing. Using the values plotted in FIGS. 5-6, the slope of the outputs 112, 114, 116 may express the sensor gain in terms of volts 118 per position.

This exemplary plot 110 has a registration device 66 with a step motor in the sheet actuator 67, which causes lateral movement 77. The stepper motor is driven at a constant frequency and hence the sheet 62 moves at a constant velocity, which is 2.5 mm/s in this example. Using the constant velocity, the sheet 62 position may be calculated by integrating the velocity over time. Thus, the output 112, 114, 116, of the three sensors 78, 80, 82 may be known as a function of the sheet 62 position.

FIG. 6 provides a partial view of the graph 110 of FIG. 5, focusing on one interval of time 120, approximately 76 to 78.5 seconds, of the sheet edge 62 moving laterally 77 towards the edge sensors 78, 80, 82 and crossing the edge sensors 78, 80, 82. Like FIG. 5, the partial view of the graph 110 shows the variation of the output 112, 114, 116 of the three sensors 78, 80, 82 as a function of time 120 and hence position, since the velocity is constant and known.

Referring to FIGS. 7(*a*)-(*c*), calibration curves are provided with the measurements of the multiple iterations of the sheet 62 crossing the edge sensors 78, 80, 82 all plotted on top of each other: The measurements relating to the sheet 62 moving laterally 77 towards the edge sensors 78, 80, 82 represented with the positive plotted x-values 122, and the measurements relating to the sheet 62 moving laterally 77 away from the edge sensors 78, 80, 82 represented with the negative plotted x-values 124. To plot the measurements, the recordings in the graph of FIG. 5 are shifted in time 120 and the time 120 was converted to a distance position 132 by multiplying time 120 by the velocity. The sensor outputs 112, 114, 116 are measured in volts 118 and are the same as in FIGS. 5-6. Additionally, by averaging each of the sensor outputs 112, 114, 116, an average sensor reading as a function of the distance position 132 may be obtained for each edge sensor 78, 80, 82.

FIG. 7(*a*) plots 130 outputs 114 from the second sensor 80 in terms of voltage 118 and the distance position 132 recordings. Outputs 116 from the third sensor 82 are plotted 140 in 7(*b*) in terms of voltage 118 and the distance position 132 recordings. FIG. 7(*c*) shows the first sensor 78 outputs 112 plotted 150 in terms of voltage 118 and the distance position 132 recordings.

Figure 7A:
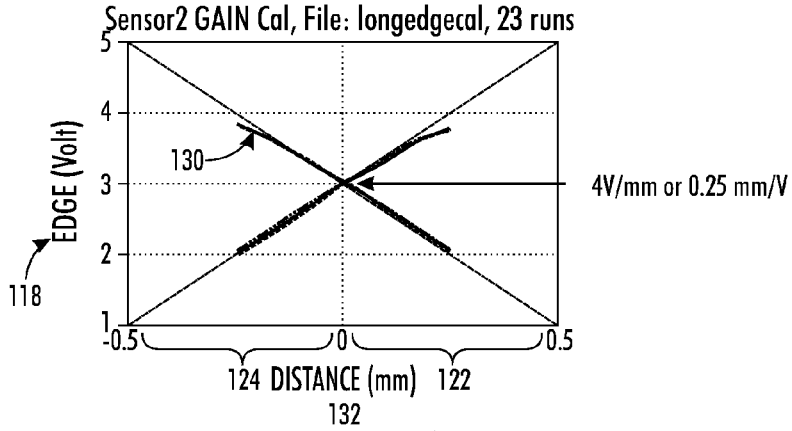
FIGS. 7(*a*)-(*c*) illustrate graphs of a linear gain for each of the three sensors in FIGS. 5-6.
Figure 7B:
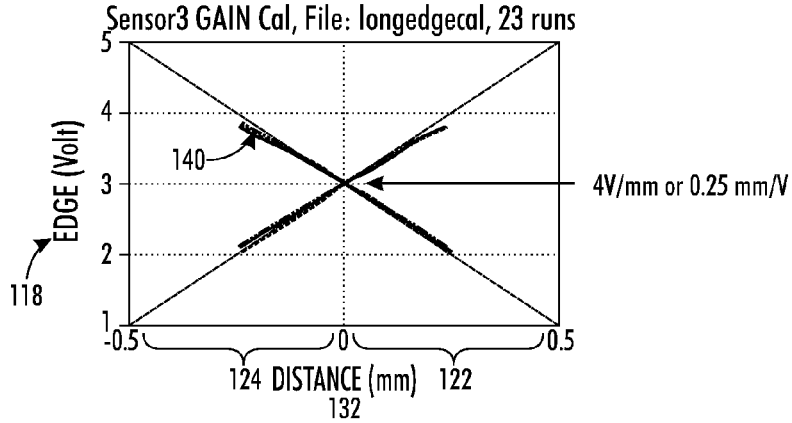
Figure 7C:
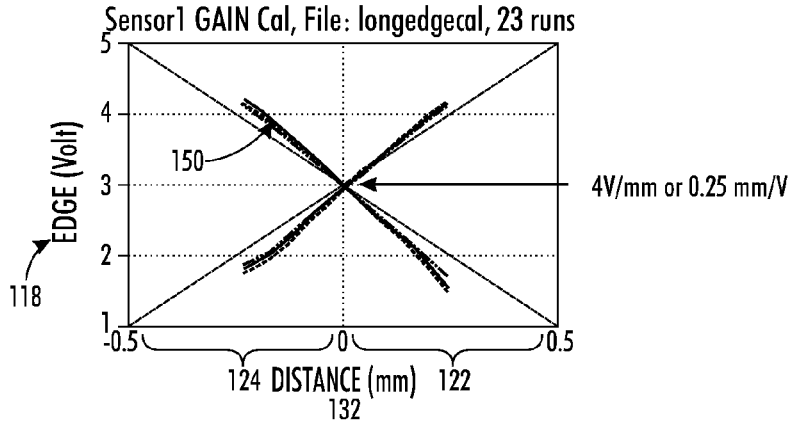

FIGS. 7(*a*)-(*c*) include dashed lines to help determine the approximate linear gain or slope. The dashed lines represent the lateral measurements recorded by the sheet actuator 67. By plotting the lateral measurements of the sheet actuator 67 and the sensor outputs 112, 114, 116 on the same graph, the linear gain may be easily viewed. FIG. 7(*a*)-(*c*) show an approximate linear gain of 4V/mm in this example. This approximation is very good for sensors 2 and 3 shown in FIGS. 7*a* and 7*b*, but sensor 1 as plotted in FIG. 7*c* needs an adjustment.

Additionally, the method 40 provided herein may be used to determine edge positions when sensor outputs 112, 114, 116 as shown in FIGS. 5, 6, and/or 7(*a*)-(*c*) are known. The inverse of the average sensor reading, which is 0.25 mm/V in this case, yields a distance position 132 measurement as a function of the sensor reading, which can be used by a sheet servo controller, registration controller or other device to convert sensor output 112, 114, 116 to edge position. The averaged sensor measurements and the inverse may be curve fitted or used with table look-up methods with interpolation/extrapolation.

The benefit of the system and method provided herein include the ability to easily calibrate sensors prior to printing to increase the accuracy of the print job. An additional benefit is the ability to use low cost sensors that can be calibrated using the method provided herein without compromising precision and accuracy of the sensors. In fact, use of low cost sensors with the method of calibration provided herein may even provide for the sensors being more precise.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A method for calibrating sensors in a printmaking device comprising:
   - transporting a media sheet along a media path, said sheet having a spaced apart lead edge and a trail edge with a measurement edge therebetween;
   - halting forward motion of said sheet after said lead edge of said sheet passes a fixed reference;
   - moving said sheet laterally relative to said media path across at least one edge sensor using a sheet actuator, said sheet actuator configured to measure a lateral position of said measurement edge of said sheet;
   - recording an actual position of said sheet actuator with reference to the media path;
   - recording an output of said at least one edge sensor; and
   - calculating a calibration factor based on said actual position of said sheet actuator and said output of said at least one edge sensor.

2. The method of claim 1, further comprising a registration device along said media path, said registration device including said at least one edge sensor.

3. The method of claim 1, wherein said sheet actuator uses a position transducer configured to measure the lateral position of said sheet.

4. The method of claim 1, wherein said sheet actuator uses a step motor configured to move said sheet along a set of predefined incremental lateral positions.

5. The method of claim 1, wherein a calibration curve is obtained from the calibration factors using the output of the sensor and said sheet actuator position.

6. The method of claim 1, wherein the steps of moving said sheet across said set of at least one edge using said sheet actuator and recording said output of said at least one edge sensor and said sheet actuator position are repeated multiple times.

7. The method of claim 6, wherein multiple recordings of said position of said sheet actuator are averaged to ensure statistically significant results.

8. The method of claim 7, wherein multiple recordings of said output of said edge sensor are averaged to ensure statistically significant results.

9. The method of claim 8, wherein said calibration factor is based on said average positions of said sheet actuator and said average output of said edge sensor.

10. The method of claim 1, wherein said at least one edge sensor is configured to have high sheet-to-sheet repeatability.

11. The method of claim 1, wherein said sheet is transported along said media path past the registration device after said at least one edge sensor is calibrated.

12. The method of claim 1, further comprising using a set of common sensors to detect a process position of said sheet along said media path.

13. The method of claim 1, wherein the sensors are calibrated while the printmaking device is not printing.

14. The method of claim 1, wherein said sheet actuator measure said lateral positions of a lateral carriage corresponding to a location of said sheet.

15. A system for use with a printmaking device to calibrate sensors comprising:

a media sheet;

a media path adapted to transport said sheet, said sheet having a spaced apart lead edge and a trail edge with and a measurement edge therebetween; and at least one edge sensor along said media path, said at least one edge sensor being configured to measure a position of said measurement edge of said sheet;

a registration device having a pair of nips and being configured to move laterally relative to said media path, wherein said registration device calibrates said at least one edge sensor using a sheet actuator, said sheet actuator configured to measure lateral positions of said measurement edge of said sheet;

wherein said registration device calibrates said at least one edge sensor by:

halting forward motion of said sheet after said lead edge of said sheet passes a fixed reference;

moving said sheet across said at least one edge sensor using said sheet actuator;

recording an actual position of said sheet actuator with reference to said media path;

recording an output of said at least one edge sensor; and calculating a calibration factor based on said actual position of said sheet actuator and said output of said at least one edge sensor.

16. The system of claim 15, wherein said sheet actuator uses a position transducer configured to measure the lateral position of said sheet.

17. The system of claim 15, wherein said sheet actuator uses a step motor configured to move said sheet along a set of predefined incremental lateral positions.

18. The system of claim 15, further comprising at least one common sensor configured to detect a process position of said sheet along said media path.

19. The system of claim 15, further comprising at least one pair of media rollers configured to control said sheet along the media path.

20. The system of claim 15, wherein said registration device uses a pair of nips to halt the forward motion of said sheet.

21. The system of claim 15, wherein said registration device is calibrated while the printmaking device is not printing.

22. A printmaking device comprising:

a calibration system including:

a media path adapted to transport a media sheet, said sheet having a spaced part lead edge and a trail edge with and a measurement edge therebetween said media path including at least one pair of nips configured to transport said sheet to said registration device and allow lateral movement of said sheet in said registration device, and at least one common sensor configured to register the timing of said sheet as said sheet is transported along said media path;

at least one edge sensor along said media path, said at least one edge sensor being configured to measure a position of said measurement edge of said sheet;

a registration device along said media path, said registration device including a pair of nips and being configured to move laterally relative to said media path, wherein said registration device calibrates at least one edge sensor using a sheet actuator, said sheet actuator is configured to measure lateral positions of said measurement edge of said sheet, and said at least one edge sensor capable of measuring lateral positions of said sheet; and a controller configured to collect and store measured lateral positions of the sheet;

wherein said calibration system calibrates said at least one edge sensor using the following steps:

halting forward motion of said sheet after said lead edge of said sheet passes a fixed reference using said registration device;

moving said sheet across said at least one edge sensor using said sheet actuator;

recording an actual position of said sheet actuator with reference to the media path;

recording an output of said at least one edge sensor; and calculating a calibration factor based on said actual position of said actuator and said output of said at least one edge sensor.

23. The device of claim 22, wherein said sheet actuator uses a position transducer configured to measure the lateral position of said sheet.

24. The device of claim 22, wherein said sheet actuator uses a step motor configured to move said sheet along a set of predefined incremental lateral positions.

25. The device of claim 22, wherein said at least one common sensor includes three common sensors configured to detect a process position of said sheet along said media path.

26. The device of claim 22, further comprising at least one pair of media rollers configured to transport said sheet along said media path prior to reaching said registration device.

27. The device of claim 22, wherein the printmaking device is calibrated while the printmaking device is not printing.

28. The device of claim 22, wherein the printmaking device uses a pair of nips to halt the forward motion of said sheet.

* * * * *